US011245986B2

(12) United States Patent
Link

(10) Patent No.: US 11,245,986 B2
(45) Date of Patent: Feb. 8, 2022

(54) ELECTRO-MAGNETIC MOTOR GEOMETRY WITH RADIAL RING AND AXIAL POLE MAGNET

(71) Applicant: Bose Corporation, Framingham, MA (US)

(72) Inventor: Christopher J. Link, Arlington, MA (US)

(73) Assignee: Bose Corporation, Framingham, MA (US)

( * ) Notice: Subject to any disclaimer, the term of this patent is extended or adjusted under 35 U.S.C. 154(b) by 15 days.

(21) Appl. No.: 16/663,065

(22) Filed: Oct. 24, 2019

(65) Prior Publication Data

US 2021/0127211 A1 Apr. 29, 2021

(51) Int. Cl.

| | |
|---|---|
| ***H04R 9/06*** | (2006.01) |
| ***H04R 9/04*** | (2006.01) |
| ***H04R 9/02*** | (2006.01) |
| ***H04R 7/12*** | (2006.01) |

(52) U.S. Cl.

CPC ..... *H04R 9/06* (2013.01); *H04R 7/127* (2013.01); *H04R 9/025* (2013.01); *H04R 9/045* (2013.01); *H04R 9/046* (2013.01); *H04R 9/063* (2013.01); *H04R 2209/022* (2013.01); *H04R 2209/024* (2013.01)

(58) Field of Classification Search

CPC ..... H04R 9/025; H04R 9/045; H04R 9/046; H04R 9/06; H04R 9/063; H04R 2209/022; H04R 2209/024; H04R 7/127

USPC ..... 381/412, 414, 420, 421, 422

See application file for complete search history.

(56) References Cited

U.S. PATENT DOCUMENTS

| | | | | |
|---|---|---|---|---|
| 3,134,057 | A | 5/1964 | Toshihiko | |
| 5,402,503 | A | 3/1995 | Prokisch | |
| 5,434,458 | A * | 7/1995 | Stuart | H04R 9/045 310/13 |
| 5,452,366 | A * | 9/1995 | Sakamoto | H04R 9/025 381/396 |
| 5,687,248 | A | 11/1997 | Yen et al. | |
| 5,729,617 | A | 3/1998 | Gruber | |
| 6,671,385 | B2 * | 12/2003 | Suzuki | H04R 9/025 381/401 |
| 7,068,807 | B2 * | 6/2006 | Kobayashi | H04R 9/025 381/412 |
| 7,197,155 | B2 * | 3/2007 | Bank | H04R 9/025 381/412 |
| 8,891,809 | B2 | 11/2014 | Danovi | |

(Continued)

FOREIGN PATENT DOCUMENTS

| | | | |
|---|---|---|---|
| JP | 2568241 | Y2 | 4/1998 |
| JP | H1155785 | A | 2/1999 |
| JP | 2007281869 | A | 10/2007 |

*Primary Examiner* — Huyen D Le
(74) *Attorney, Agent, or Firm* — Bose Corporation

(57) ABSTRACT

An electro-acoustic transducer includes a diaphragm and an electro-magnetic motor that is coupled to the diaphragm. The motor includes a voice coil and a magnetic circuit that defines an air gap within which the voice coil is at least partially disposed. The magnetic circuit includes a first, axially polarized permanent magnet that provides a first magnetic flux path and a second, radially polarized permanent magnet that provides a second magnetic flux path. The first and second magnetic flux paths are arranged to interact with the voice coil to drive motion of the diaphragm.

16 Claims, 4 Drawing Sheets

(56) References Cited

U.S. PATENT DOCUMENTS

| | | | | |
|---|---|---|---|---|
| 9,143,871 | B2 | 9/2015 | Van Doorn | |
| 9,628,884 | B2 | 4/2017 | Pare et al. | |
| 2004/0131223 | A1* | 7/2004 | Stiles ..... | H04R 9/063<br>381/412 |

* cited by examiner

ELECTRO-MAGNETIC MOTOR GEOMETRY WITH RADIAL RING AND AXIAL POLE MAGNET

BACKGROUND

This disclosure relates to an electro-magnetic motor geometry with radial ring and axial pole magnets, e.g., for use in an electro-acoustic transducer for a loudspeaker.

SUMMARY

All examples and features mentioned below can be combined in any technically possible way.

In one aspect, an electro-acoustic transducer includes a diaphragm and an electro-magnetic motor that is coupled to the diaphragm. The motor includes a voice coil and a magnetic circuit that defines an air gap within which the voice coil is at least partially disposed. The magnetic circuit includes a first, axially polarized permanent magnet that provides a first magnetic flux path and a second, radially polarized permanent magnet that provides a second magnetic flux path. The first and second magnetic flux paths are arranged to interact with the voice coil to drive motion of the diaphragm.

Implementations may include one of the following features, or any combination thereof.

In some implementations, the electro-magnetic motor includes a center pole. The first permanent magnet is mounted to a top end surface of the center pole, and the air gap is defined between an outer surface of the center pole and an inner surface of the second permanent magnet.

In certain implementations, the first permanent magnet is arranged above a range of motion of the voice coil.

In some cases, the first magnet is arranged such that its bottom surface is opposite in polarity to an inner diameter of the second magnet.

In certain cases, the second magnetic flux path extends above the air gap.

In some examples, the first and second magnetic flux paths constructively interfere within the air gap.

In certain examples, the voice coil has an overhung configuration in which a height of the voice coil is greater than a height of the air gap.

In some implementations, the voice coil has an underhung design in which a height of the voice coil is small than a height of the air gap.

In certain implementations, the transducer has a BL curve that is substantially symmetrical about a rest position of the voice coil.

In some cases, the rest position of the voice coil corresponds to a maximum BL position of the transducer.

In certain cases, the electro-acoustic transducer includes a magnetically permeable plate arranged on top of the first permanent magnet, such that the first permanent magnet is disposed between the center pole and the magnetically permeable plate.

In some examples, the magnet assembly includes a magnetically permeable core that defines a center pole and a sidewall disposed circumferentially about the center pole. The second permanent magnet is supported on the sidewall.

In certain examples, the center pole and the second permanent magnet define the air gap within which the voice coil is at least partially disposed.

In some implementations, the magnetically permeable core includes a backplate that couples the sidewall to the center pole.

In certain implementations, the first and second magnetic flux paths constructively interfere such that the flux density is substantially linear along (i.e., along the height) the air gap.

In some cases, the first magnet is a disc magnet and the second magnet is a ring magnet.

In certain cases, the disc magnet is positioned above a range of motion of the voice coil, and the disc magnet is arranged such that its bottom surface is opposite in polarity to an inner diameter of the ring magnet.

Another aspect features an electro-magnetic motor for a loudspeaker. The electro-magnetic motor includes a voice coil, an axially polarized disc magnet, a radially polarized ring magnet, and a magnetically permeable core that supports the disc magnet and the ring magnet. The magnetically permeable core includes a center pole and a sidewall disposed about the center pole. The disc magnet is mounted to a top end surface of the center pole and the ring magnet is mounted to the sidewall such that the magnetically permeable core and the ring magnet together define an air gap within which the voice coil is at least partially disposed. The disc magnet is arranged such that its bottom surface is opposite in polarity to an inner diameter of the radial ring magnet.

Implementations may include one of the above and/or below features, or any combination thereof.

In some implementations, the disc magnet is positioned above a range of motion of the voice coil.

In another aspect, an electro-magnetic motor includes a coil and a magnetic circuit defining an air gap within which the coil is at least partially disposed. The magnetic circuit includes a first, axially polarized permanent magnet providing a first magnetic flux path and a second, radially polarized permanent magnet providing a second magnetic flux path. The first and second magnetic flux paths are arranged to interact with the coil to drive motion of the coil.

Implementations may include one of the above features, or any combination thereof.

DETAILED DESCRIPTION

This disclosure is based, at least in part, on the realization that, in an electro-acoustic transducer, an axial pole magnet and a radial ring magnet can be used in combination to increase flux across a coil by creating an additional return path.

Figure 1:
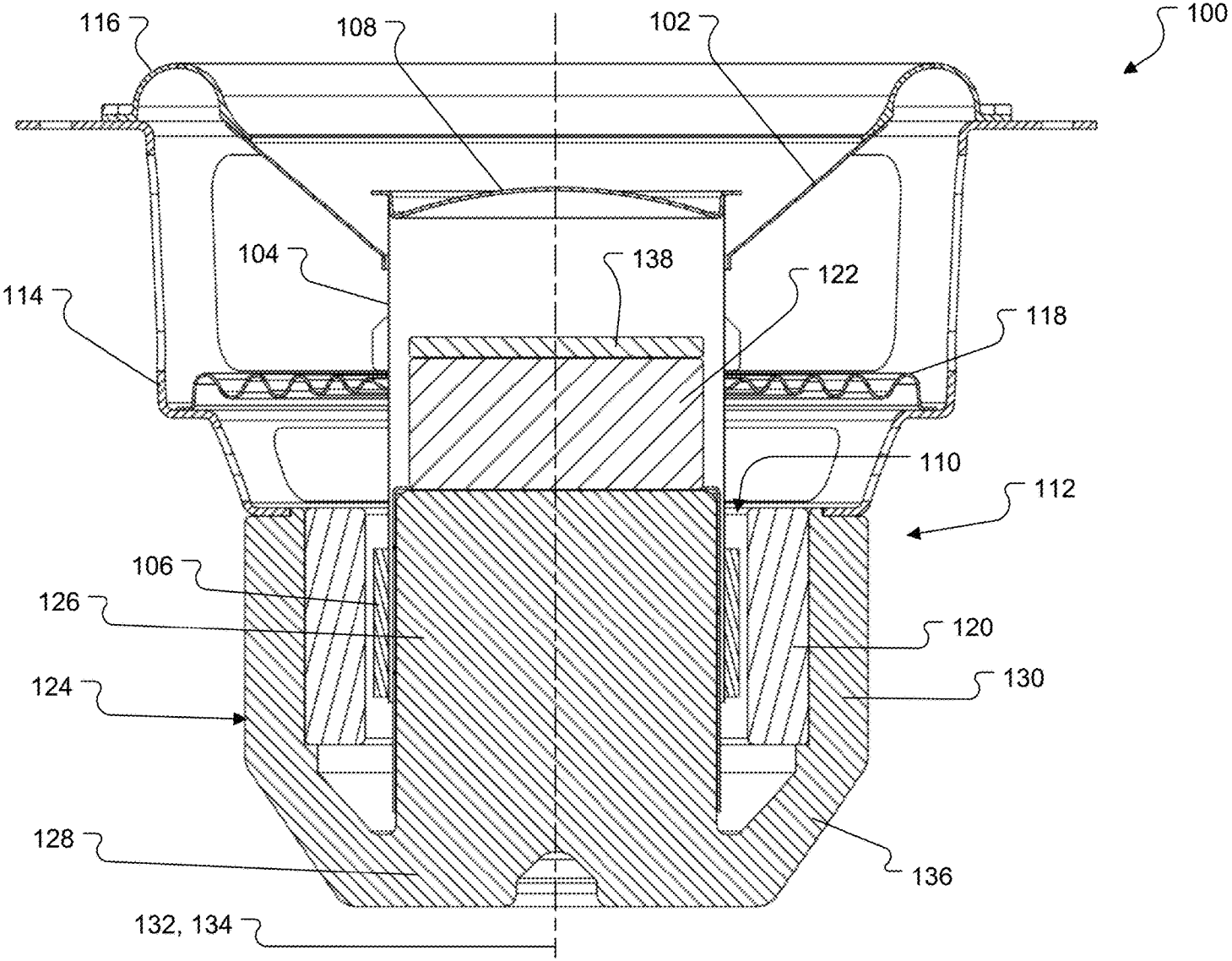
FIG. 1 is a cross-sectional side view of an electro-acoustic transducer.

Referring to FIG. 1 (cross-sectional side view of transducer), an electro-acoustic transducer 100 includes a diaphragm 102 connected to a voice coil assembly which includes a bobbin 104 and a voice coil 106. A dust cap 108 covers a top of the bobbin 104 on which the voice coil 106 is wound. The voice coil 106 is positioned in an air gap 110 provided by a magnetic circuit 112. The voice coil 106 and the magnetic circuit 112 together providing an electro-magnetic motor for driving motion of the diaphragm 102. In that regard, the magnetic circuit 112 is configured for creating magnetic flux across the gap 110 which the voice coil 106 interacts with. When electrical current in the voice coil 106 changes direction, magnetic forces between the voice coil 106 and the magnetic circuit also change causing the voice coil 106 to move up and down in a pistonic motion between a fully extended position, in which the diaphragm 102 is displaced away from the magnetic circuit 112, and a fully retracted position, in which the diaphragm 102 is drawn inward towards the magnetic circuit 112. The voice coil 106 may include gold, silver, aluminum, or copper wire.

An outer edge of the diaphragm 102 is attached to a rigid basket 114 along an annular mounting flange by a first suspension element (a/k/a surround 116). The bobbin 104 is coupled to the basket 114 via a second suspension element (a/k/a spider 118), which provides for rocking stability.

The magnetic circuit 112 includes a radially polarized ring magnet 120, an axially polarized disc magnet 122, and a magnetically permeable core 124 disposed therebetween.

The radially polarized ring magnet 120 is a ring shaped permanent magnet with a specific magnetic pattern that includes a first magnetic pole on the outer diameter (OD) of the ring and a second, opposite, magnetic pole on the inner diameter (ID) of the ring, which provides a radial magnetic field in which the magnetic lines of force converge towards the center of the ring and diverge away from the center of the ring.

The axially polarized disc magnet 122 is in the shape of a disc or coin and is magnetized along its geometric axis. That is, the north and south poles are located on the flat, opposing faces at the top and bottom of the magnet such that the magnetization direction is along the axis of the magnet.

The magnetically permeable core 124 includes a center pole 126, a backplate 128, and a sidewall 130. The center pole 126 extends upwardly from the backplate 128 along its axis 132, which is coincident with the motion axis 134 of the electro-acoustic transducer 100. The sidewall 130 is in the shape of a hollow cylinder that circumferentially surrounds the center pole 126. In the illustrated example, a tapered wall section 136 couples the sidewall 130 to the backplate 128. The sidewall 130 supports the radial ring magnet 120 along the inner surface of the sidewall 130 such that the air gap 110 is defined between the outer surface of the center pole 126 and the inner surface of the ring magnet 120. The center pole 126, backplate 128, and sidewall 130 may be formed as a single integral part or may comprise two or more discrete pieces that are coupled together, e.g., using adhesive, bonding agents, or mechanical fasteners. The center pole 126, backplate 128, and sidewall 130 are formed of one or more magnetically highly conductive materials, such as steel, a steel alloy, and/or any other magnetically conductive materials.

The disc magnet 122 is arranged on a top end of the center pole 126 and above the range of motion of the coil 106. In the illustrated example, a metal plate 138 is provided at the top surface of the disc magnet 122 to help inhibit demagnetization of the disc magnet 122. The metal plate 138 may be formed of steel. The disc magnet 122 is arranged such that its bottom surface is opposite in polarity to the inner diameter of the ring magnet 120. For example, if the inner diameter of the ring magnet 120 is that magnet's North pole, then the bottom surface of the disc magnet 122 will be that magnet's South pole and vice-versa.

Figure 2:
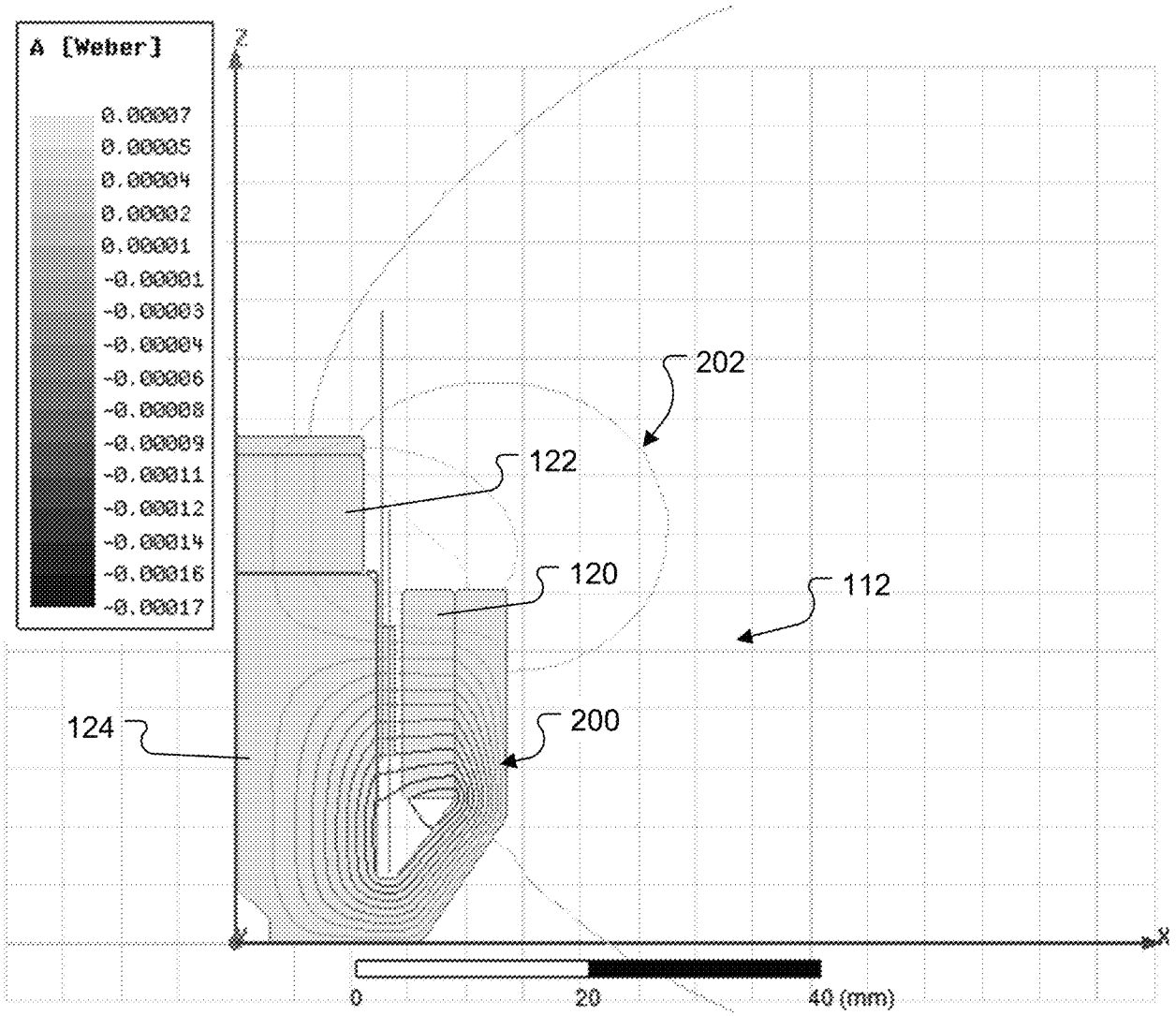
FIG. 2 illustrates the magnetic flux paths for a magnetic circuit of the electro-acoustic transducer of FIG. 1.

The addition of the disc magnet 122 helps to reduce leakage of magnetic flux, and increase the magnetic flux across the coil, by creating an additional return path for magnetic flux above the coil range of motion. FIG. 2 illustrates a cross-sectional view of a part of the magnetic circuit 112. As shown in FIG. 2, a first flux path 200 is provided via the ring magnet 120 and the magnetically permeable core 124 and a second flux path 202 is provided via the interaction of the disc magnet 122, the magnetically permeable core 124, and the radial ring magnet 120. As a result, the magnetic flux density of the magnetic circuit 112 is increased to provide a magnetic circuit that is suitable for a small, powerful and highly efficient electro-acoustic transducer 100. The permanent magnets described herein may be composed of any permanent magnetic material, including neodymium ferrite, or any other metallic or non-metallic materials capable of being magnetized to include an external magnetic field.

The implementation illustrated in FIG. 2 was modeled with a ring magnet 120 having an inner diameter of 29 mm, an outer diameter of 38.2 mm (for a radial thickness of 4.6 mm), and a height of 18 mm; and a disc magnet 122 with an outer diameter of 22.3 mm and a height of 10 mm.

Figure 3:
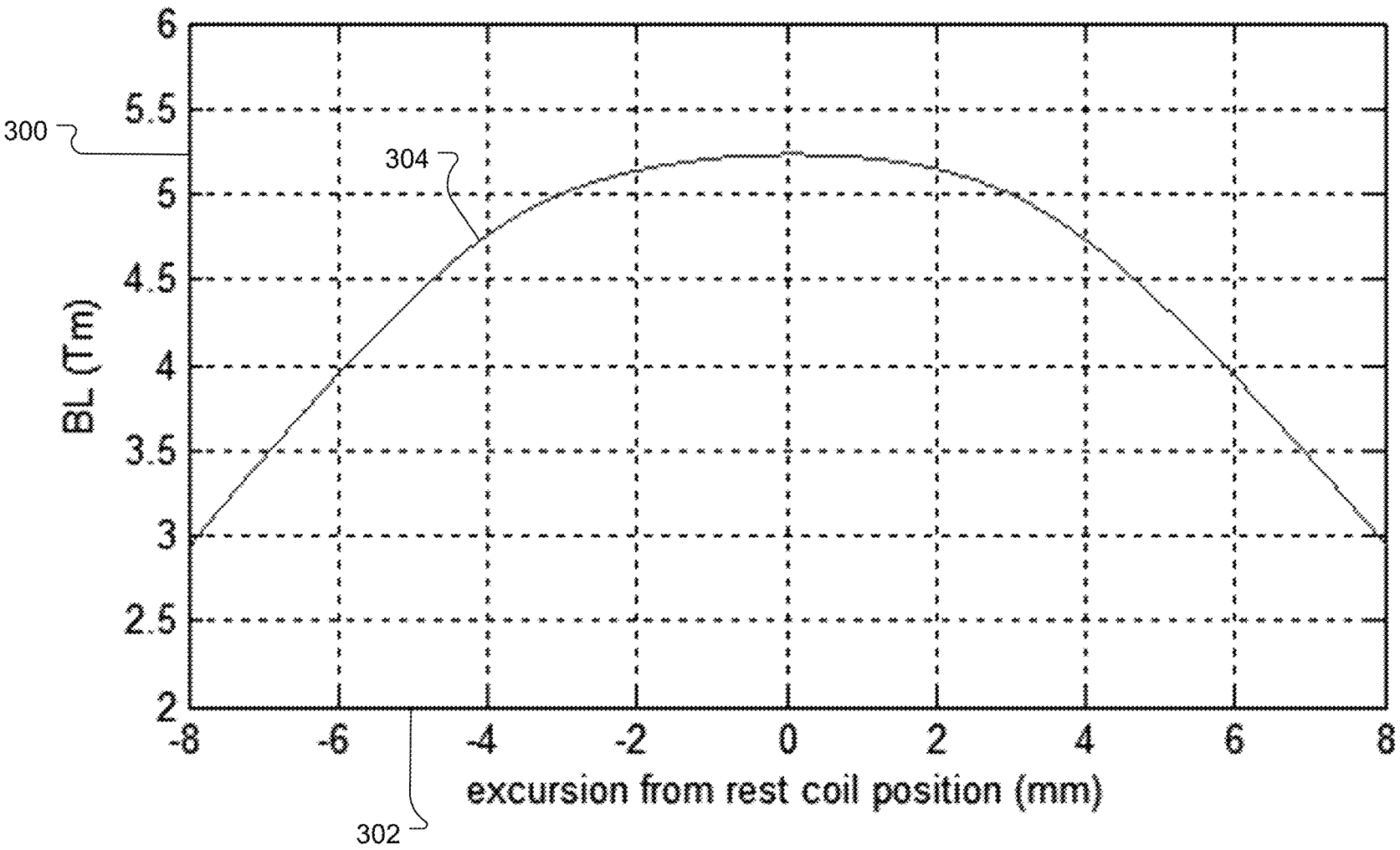
FIG. 3 is a plot showing a voice coil motor force constant versus the voice coil position in an air gap relative to a half-width beta (HWB) position of the voice coil for an electro-acoustic transducer constructed according to this disclosure.

FIG. 3 shows the voice coil motor force constant (BL—Tesla meters; y-axis 300) versus the voice coil position in the air gap 110 relative to a half-width beta (HWB) position of the voice coil (positive or negative millimeters, x-axis 302). The HWB position can be a rest position of the voice coil without an input signal. Positive distance indicates the voice coil 106 moving away from the rest position and away from the backplate 128 in response to the voice coil with an input signal, and a negative distance indicates the voice coil moving away from the rest position toward the backplate 128 in response to the voice coil 106 with an input signal. As shown in FIG. 3, the BL curve 304 for the magnetic circuit 112 being modeled is highly symmetrical and highly linear about the zero (rest) position.

Figure 4:
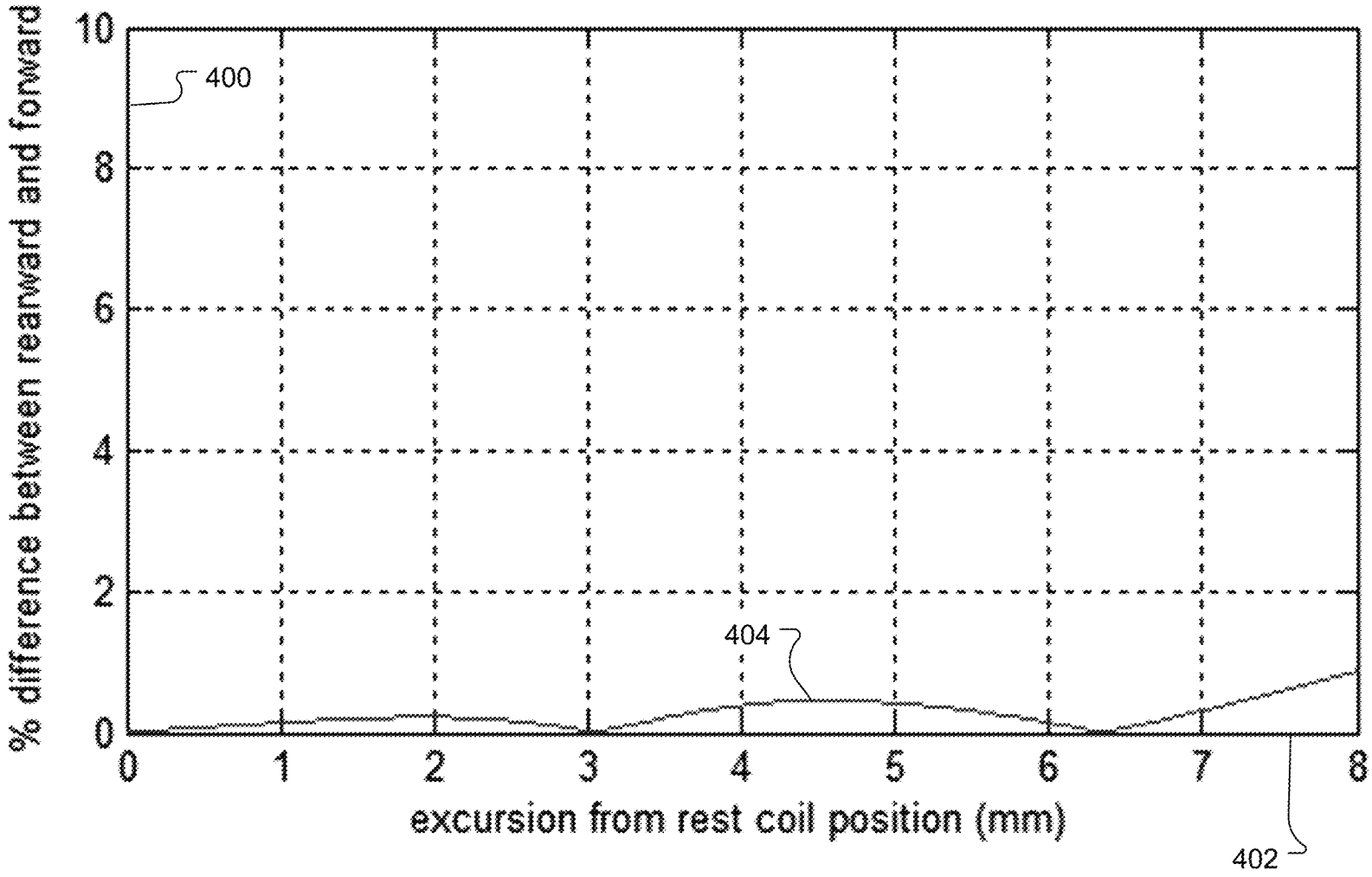
FIG. 4 is a plot showing the percent difference in the voice coil motor force constant, BL, between rearward and forward excursion for an electro-acoustic transducer constructed according to this disclosure.

FIG. 4 provides another visualization of the symmetry enabled by the magnetic circuit 112. FIG. 4 plots the percent difference, in the voice coil motor force constant, BL, between rearward and forward excursion (%; y-axis 400) as a function of the excursion of the voice coil from the HWB rest position (mm; x-axis 402). As can be seen from the graph in FIG. 4, the asymmetry 404 (% difference between rearward and forward motion) remains low, below 1%, over the entire range of 0 to 8 mm.

Other Implementations

While the implementation illustrated above shows an electro-acoustic transducer with an underhung voice coil configuration in which the coil is shorter than the air gap, other implementations may use an overhung voice coil configuration with windings that are taller than the height of the air gap.

A number of implementations have been described. Nevertheless, it will be understood that additional modifications may be made without departing from the scope of the inventive concepts described herein, and, accordingly, other implementations are within the scope of the following claims.

What is claimed is:

1. An electro-acoustic transducer comprising:

a diaphragm; and an electro-magnetic motor coupled to the diaphragm, the motor comprising:

a voice coil; and a magnetic circuit defining an air gap within which the voice coil is at least partially disposed, the magnetic circuit comprising:

a first, axially polarized permanent magnet providing a first magnetic flux path;

a second, radially polarized permanent magnet providing a second magnetic flux path; and a center pole, wherein the first permanent magnet is mounted to a top end surface of the center pole, wherein the air gap is defined between an outer surface of the center pole and an inner surface of the second permanent magnet, and wherein the first and second magnetic flux paths are arranged to interact with the voice coil to drive motion of the diaphragm.

2. The electro-acoustic transducer of claim 1, wherein the first permanent magnet is arranged above a range of motion of the voice coil.

3. The electro-acoustic transducer of claim 2, wherein the first magnet is arranged such that its bottom surface is opposite in polarity to an inner diameter of the second magnet.

4. The electro-acoustic transducer of claim 2, further comprising a magnetically permeable plate arranged on top of the first permanent magnet, such that the first permanent magnet is disposed between the center pole and the magnetically permeable plate.

5. The electro-acoustic transducer of claim 1, wherein the second magnetic flux path extends above the air gap.

6. The electro-acoustic transducer of claim 1, wherein the first and second magnetic flux paths constructively interfere within the air gap.

7. The electro-acoustic transducer of claim 1, wherein the voice coil has an overhung configuration in which a height of the voice coil is greater than a height of the air gap.

8. The electro-acoustic transducer of claim 1, wherein the voice coil has an underhung design in which a height of the voice coil is small than a height of the air gap.

9. The electro-acoustic transducer of claim 1, wherein the transducer has a BL curve that is substantially symmetrical about a rest position of the voice coil.

10. The electro-acoustic transducer of claim 9, wherein the rest position of the voice coil corresponds to a maximum BL position of the transducer.

11. The electro-acoustic transducer of claim 1, wherein the magnetic circuit further comprises a magnetically permeable core that defines:

the center pole; and a sidewall disposed circumferentially about the center pole, wherein the second permanent magnet is supported on the sidewall.

12. The electro-acoustic transducer of claim 11, wherein the center pole and the second permanent magnet define the air gap within which the voice coil is at least partially disposed.

13. The electro-acoustic transducer of claim 11, wherein the magnetically permeable core further comprises a backplate that couples the sidewall to the center pole.

14. The electro-acoustic transducer of claim 1, wherein the first and second magnetic flux paths constructively interfere such that the flux density is substantially linear along the air gap.

15. The electro-acoustic transducer of claim 1, wherein the first magnet is a disc magnet and the second magnet is a ring magnet.

16. The electro-acoustic transducer of claim 15, wherein the disc magnet is positioned above a range of motion of the voice coil, and wherein the disc magnet is arranged such that its bottom surface is opposite in polarity to an inner diameter of the ring magnet.

* * * * *